United States Patent [19]

Ogle

[11] 4,005,671

[45] Feb. 1, 1977

[54] ADJUSTABLE STRENGTH ANCHOR

[75] Inventor: Leo D. Ogle, Longview, Tex.

[73] Assignee: The Raymond Lee Organization, Inc., a part interest

[22] Filed: June 21, 1976

[21] Appl. No.: 698,054

[52] U.S. Cl. ..... 114/298

[51] Int. Cl.[2] ..... B63B 21/44

[58] Field of Search ..... 114/208 A, 208 R, 207; 267/175, 177

[56] References Cited

UNITED STATES PATENTS

| | | | |
|---|---|---|---|
| 2,629,357 | 2/1953 | Jones | 114/208 A |
| 2,985,132 | 5/1961 | Detrick | 114/208 A |
| 3,206,153 | 9/1965 | Burk | 267/177 X |
| 3,747,553 | 7/1973 | Riddle | 114/208 A |

*Primary Examiner*—Trygve M. Blix
*Assistant Examiner*—Gregory W. O'Connor

[57] ABSTRACT

A hollow elongated cylinder has a cup with a central opening at one end and is open at the other. A plurality of equidistantly spaced like slots are cut into the cylinder wall and extend for a short distance in the axial direction from the other end toward the cap. An elongated bar parallel to the axis of the cylinder is secured to the inner wall of the cylinder, one end of the bar being adjacent the cap, the other end of the bar being adjacent the slots. A threaded bolt is aligned with the axis of the cylinder and is disposed therein, the head of the bolt being alignable with the slots, the end of the bolt extending through the opening of the cap. An eye is secured to the exposed end of the bolt. A flat circular disc has a central threaded bore threadedly engaged by said bolt, the disc being disposed in the cylinder and having a diameter slightly smaller than that of the interior of the cylinder. The disc has a portion cut away whereby the disc bears against the bar slidably but non-rotatably. A coil spring is disposed concentrically about the bolt inside the cylinder, one end of the spring bearing against the cap, the other end of the spring bearing against the disc. Each of a plurality of elongated arms extends through a corresponding slot, one end of each arm being disposed within the cylinder and engagable by said bolt head, a major portion of each arm extending outside of the cylinder. A like plurality of devices are disposed outside the cylinder, each device being aligned with a corresponding slot and pivotally securing each arm to said cylinder at a point intermediate its ends but adjacent the one end of the arm.

4 Claims, 4 Drawing Figures

FIG.1
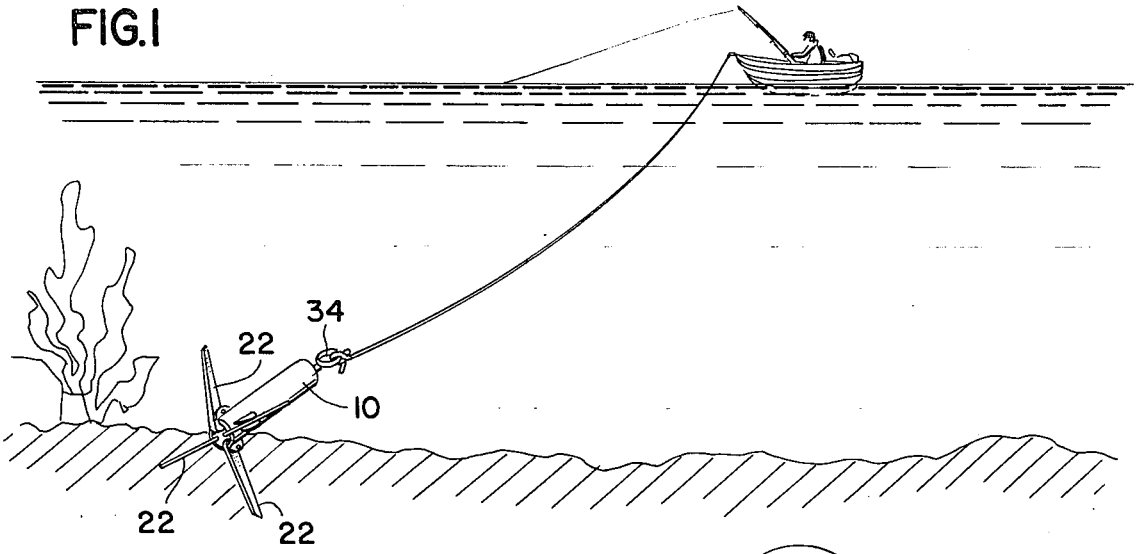
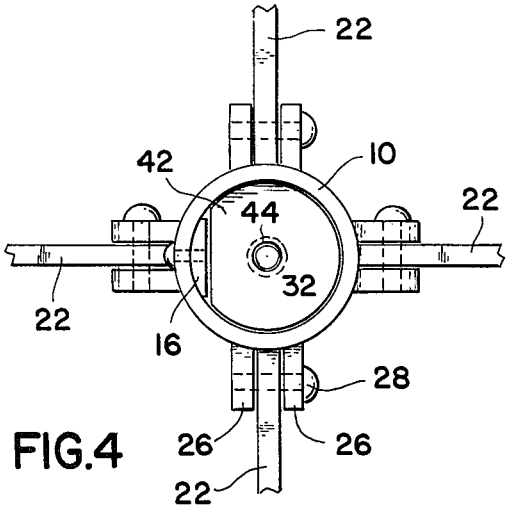
FIG.4
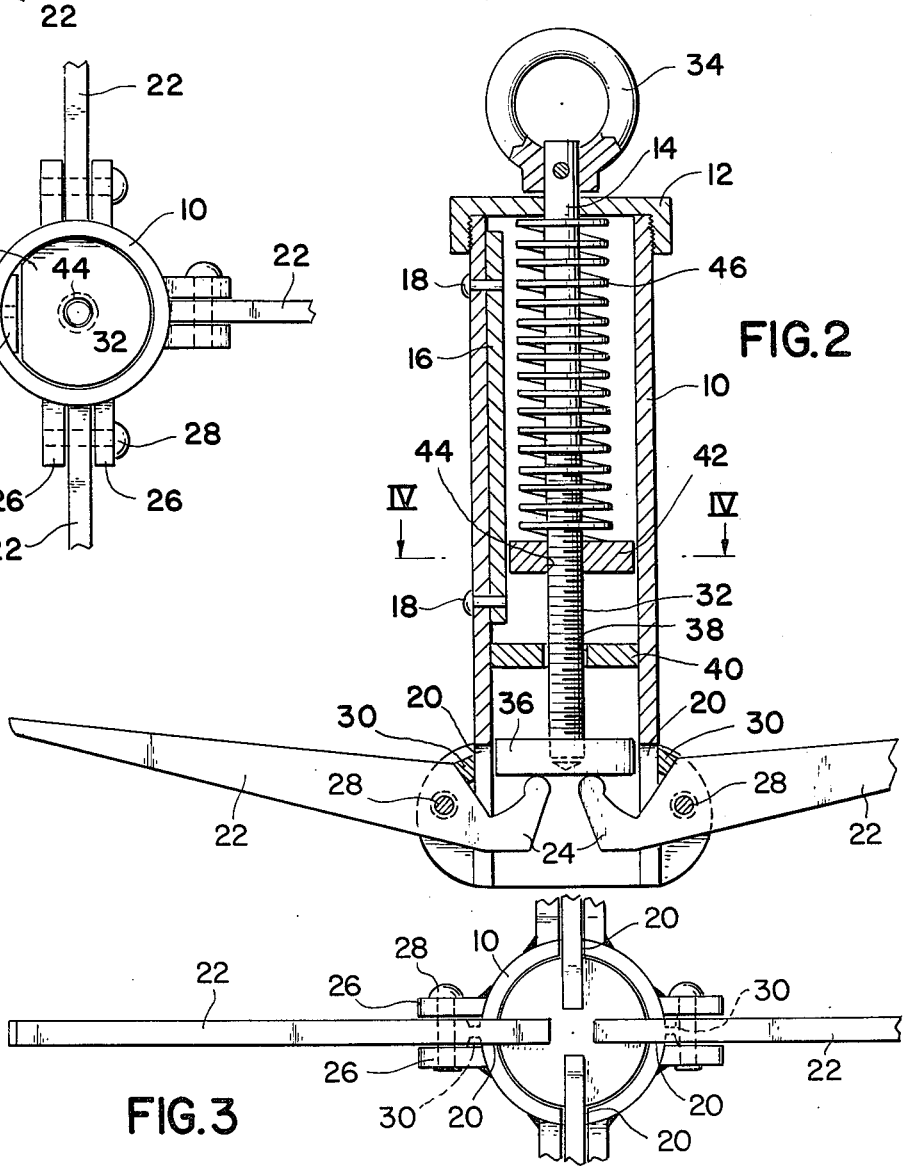
FIG.2
FIG.3

ADJUSTABLE STRENGTH ANCHOR

SUMMARY OF THE INVENTION

This invention is directed toward an anchor which can be set to be released under different strengths of pull depending upon the type of use whereby for example when the anchor is in muddy or sandy bottom a heavy pull is required for release whereas when the anchor is in bursh, trees, or roots, a light or medium pull is required for release.

An anchor in accordance with the invention employs an elongated hollow cylinder having a cap with central opening at one end and open at the other end. A plurality of equidistantly spaced like slots are cut into the cylinder wall and extend for a short distance in the axial direction from the other end toward the cap.

An elongated bar parallel to the axis of the cylinder is secured to the inner wall of the cylinder, one end of the bar being adjacent the cap, the other end of the bar adjacent the slots.

A threaded bolt is aligned with the axis of the cylinder and is disposed therein, the head of the bolt being alignable with the slots, the end of the bolt extending through the opening of the cap. An eye is secured to the exposed end of the bolt.

A flat circular disc has a central threaded bore threadedly engaged by said bolt, said disc being disposed in the cylinder and having a diameter slightly smaller than that of the interior of the cylinder. The disc has a portion cut away whereby the disc bears against the bar slidably but nonrotatably.

A coil spring is disposed concentrically about the bolt inside the cylinder, one end of the spring bearing against the cap, the other end of of the spring bearing against disc. Each of a like plurality of elongated arms extends through a corresponding slot, one end of each arm being disposed within the cylinder and engagable by said bolt head, a major portion of each arm extending outside of the cylinder.

A like plurality of means are disposed outside the cylinder, each means being aligned with a corresponding slot and pivotally securing each arm at a point intermediate its ends but adjacent said one end of the arm to said cylinder.

In use, the eye can be rotated either direction to raise or lower the disc, thereby compressing or releasing the spring and increasing or decreasing the strength or tension required to be exerted or the eye to move the bolt head out of engagement with the end of the arms inside they cylinder. This movement of the head allows the arms to pivot into positions essentially parallel to the axis of the cylinder whereby the arms do not resist the pulling action and the anchor is released. In the absence of the pull, the head of the bolt bears against the end of the arms in the cylinder and forces the arms outward at right angels to the cylinder whereby maximum holding action of the anchor is obtained.

BRIEF DESCRIPTION OF THE DRAWINGS

FIG. 1 shows the invention in use.

FIG. 2 is a side crosssectional view of the invention.

FIG. 3 is a bottom view of the invention.

FIG. 4 is a view taken along line 4—4 in FIG. 2.

DETAILED DESCRIPTION OF PREFERRED EMBODIMENT

Referring now to FIGS. 1–4, an elongated vertical hollow cylinder 10 has a cap 12 threadedly engaging the top end, this cap having a central opening 14. An elongated vertical bar 16 disposed entirely within the cylinder is secured to the inner wall thereof by rivets 18 or other means. The top end of the bar is adjacent the cap and the bottom end of the bar is disposed about two thirds of the entire length of the cylinder.

The bottom end of the cylinder is open. Four equidistantly disposed like slots 20 are cut into wall of the cylinder and extend vertically upward from the bottom end to about one fifth or one quarter of the length of the cylinder. Each of four like elongated arms or flukes 22 has a vertical V shaped opening cut therein adjacent one end 24 whereby this end forms a thin extension disposed almost at right angles to the direction of elongation of the arm. The apex of the V is disposed just inside the cylinder wall adjacent the corresponding slot with end 24 disposed within the cylinder. The remaining portion of each arm extends outside of the cylinder and tapers to a point. Spaced plates 26 secured to the cylinder at each slot and straddling same support a horizontal pin 28 about which each corresponding arm is pivotally secured. Short bars 30 secured to these plates and extending inward prevent the arms from pivoting upward along the outside of the cylinder above the position shown in FIG. 2. These bars thus act as stops.

An elongated threaded bolt 32 extends axially with the cylinder. The upper end of the bolt extends through the opening of the cap and eye 34 is secured thereto. The bolt 32 adjacent its lower end which is an elongated head 36 passes through the center opening 38 of a horizontal circular disc 40 welded or otherwise secured to the wall of the cylinder and acting as a guide for the bolt. Normally, the head bears against ends 24 and forces the arms to be pivoted almost in horizontal position whereby the anchor provides anchoring action.

A flat horizontal circular disc 42 has a threaded central bore 44 threadedly engaged by the bolt. The disc 42 has a portion cut away whereby this disc which is so disposed as to always bear against the bar 16 slidably but non rotatably. A coil spring 46 disposed concentrically about the bolt has one end bearing against the cap and an opposite end bearing against the disc. Manually rotating the eye in one direction causes the disc 42 to rise, squeezing the spring and increasing the tension force required to be executed along the dual direction or the eye to pull the head up and release the arms. Rotation in opposite direction causes the disc 42 to fall whereby the tension force is decreased.

While the invention has been described with particular reference to the drawings, the protection sought is to be limited only by the terms of the claims that follow.

I claim:

1. An anchor comprising:

a hollow elongated cylinder having a cap with a central opening at one end and open at the other end, said cylinder having a plurality of equidistantly spaced like slots in the wall which extend for a short distance in the axial direction from the other end toward the cap;

an elongated bar parallel to the axis of the cylinder and secured to the inner wall of the cylinder, one end of the bar being adjacent the cap, the other end of the bar being adjacent the slots;

a threaded blot aligned with the axis of the cylinder and disposed therein, the head of the bolt being alignable with the slots, the end of the bolt extending through the opening of the cap;

an eye secured to the exposed end of the bolt;

a flat circular disc having a central threaded bore threadedly engaged by said bolt, said disc being disposed in the cylinder and having a diameter slightly smaller than that of the interior of the cylinder, said disc having a portion cut away whereby the disc bears against the bar slidably but non-rotatably;

a coil spring disposed concentrically about the bolt inside the cylinder, one end of the spring bearing against the cap, the other end of the spring bearing against the disc;

a plurality of like elongated arms, each arm extending through a corresponding slot, one end of each arm being disposed within the cylinder and engagable by said bolt head, a major portion of each arm extending outside of the cylinder; and a like plurality of means disposed outside the cylinder, each means being aligned with a corresponding slot and pivotally securing each arm to said cylinder at a point intermediate its ends but adjacent said one end of the arm.

2. The anchor claim 1 further including bolt guide means disposed in the cylinder between said disc and said head.

3. The anchor of claim 2 wherein each means is provided with stops to limit the pivotable action of the corresponding arm and prevent said arm from pivoting alongside the cylinder wall.

4. The anchor of claim 3 wherein said bolt guide means is a flat disc secured in the cylinder with a central opening through which the bolt extends.

* * * * *